US005129509A

United States Patent [19]

Romolt

[11] Patent Number: 5,129,509

[45] Date of Patent: Jul. 14, 1992

[54] SPECTACLE CASE

[76] Inventor: Abe Romolt, 17032 Burbank Blvd. #16, Encino, Calif. 91316

[21] Appl. No.: 740,122

[22] Filed: Aug. 5, 1991

[51] Int. Cl.[5] ..... A45C 11/04

[52] U.S. Cl. ..... 206/5; 206/204; 206/38; 24/3 G

[58] Field of Search ..... 206/5, 38, 235, 204; 24/3 C, 3 G, 11 R, 11 CT; 150/131, 137, 154; 224/252

[56] References Cited

U.S. PATENT DOCUMENTS

| | | | |
|---|---|---|---|
| 432,214 | 7/1890 | Prentice | 206/5 |
| 1,834,419 | 12/1931 | Pratt | 206/5 |
| 2,102,218 | 12/1937 | Rakauskas | 206/5 |
| 2,650,700 | 9/1953 | Wolf | 206/5 |
| 2,732,061 | 1/1956 | Wilcox | 206/5 |
| 2,758,707 | 8/1956 | Baratelli | 206/5 |
| 2,784,837 | 3/1957 | Marks | 206/5 |
| 3,749,231 | 7/1973 | Nathan | 206/5 |
| 3,938,655 | 2/1976 | Romolt | 206/5 |
| 4,044,933 | 8/1977 | Artz | 224/252 |
| 4,148,422 | 4/1979 | Habler | 224/252 |
| 4,267,923 | 5/1981 | Baratelli et al. | 206/5 |
| 4,705,086 | 11/1987 | O'Neill | 150/137 |
| 4,771,515 | 9/1988 | Guarro | 24/3 C |
| 4,915,215 | 4/1990 | Brekke | 24/3 G |

*Primary Examiner*—David T. Fidei
*Attorney, Agent, or Firm*—Leon Gilden

[57] ABSTRACT

A flexible porous inner web is mounted to a fluid impermeable outer web to define an entrance opening to receive a spectacle case, wherein the inner web includes an adhesive web including an adhesive forward face mounting a "U" shaped clip, and an adhesive rear face adhesively secured to the inner web, wherein the "U" shaped clip includes a junction and the outer web includes a slot, wherein the junction is aligned with the slot, with the inner web secured to the outer web. The case structure may further utilize the adhesive web formed with adhesive at a forward surface thereof and mounted to an interior surface of the outer web to secure the clip through the slot and the outer web without use of an inner liner. A modification of the invention includes the inner liner including an anhydrous dispensing tube contained therewithin for directing a water absorbing mixture from interiorly of the case structure.

1 Claim, 4 Drawing Sheets

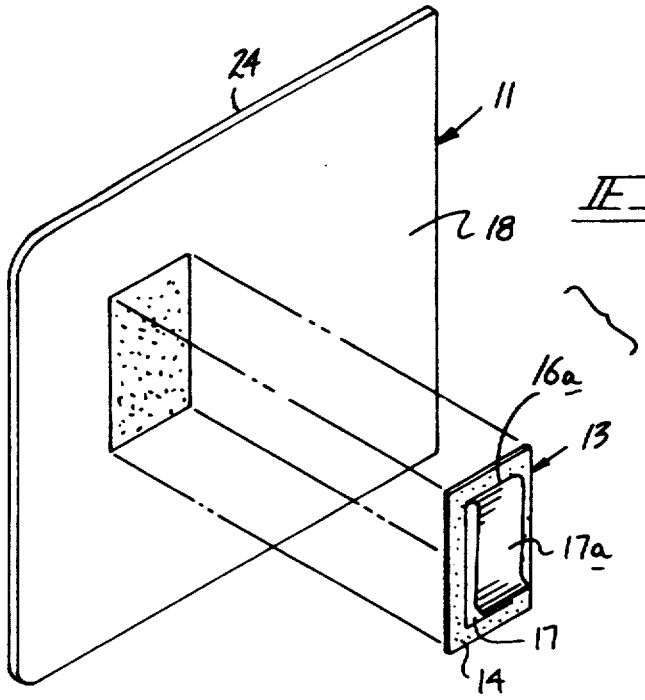
Fig 7
Fig 8
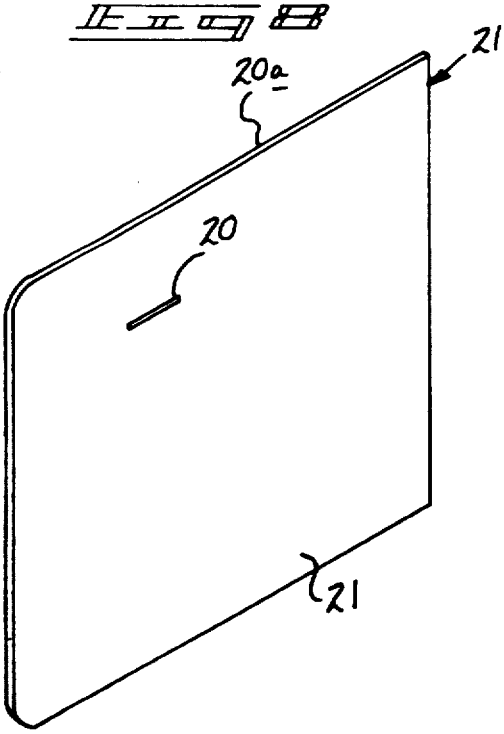
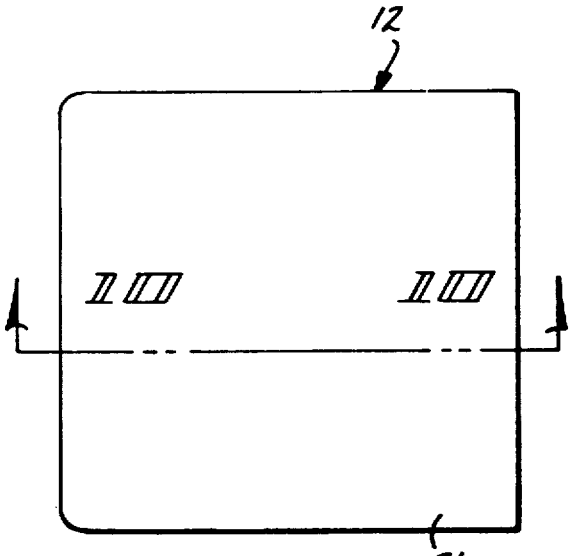
Fig 9
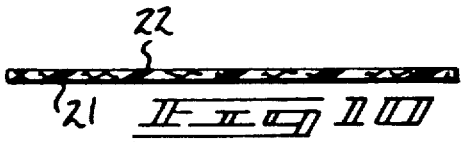
Fig 10

SPECTACLE CASE

BACKGROUND OF THE INVENTION

1. Field of the Invention

The field of invention relates to eyeglass case structure, and more particularly pertains to a new and improved spectacle case wherein the same is arranged to secure and mount a spectacle assembly therewithin.

2. Description of the Prior Art

Eyeglass case structure is utilized throughout the prior art to contain spectacles in a protective and secure manner. Typically, these cases are formed with a relatively soft outer layer and formed with an inner liner in an optional manner to secure an eyeglass assembly therewithin. While hard cases have been utilized in the prior art, the soft cases are more suitable to storage and reception within pockets and the like about an individual while affording adequate protection to a spectacle or eyeglass assembly contained therewithin.

Such spectacle case structure is typically given in association with a spectacle pair by an optometrist wherein the instant invention addresses an effort to reduce costs of construction by providing a somewhat adhesive clip structure mounted to the flexible outer liner and directed through a slot in the flexible outer liner to minimize costs of assembly and construction of the organization, as well as expediting manufacturing capacity required of large numbers of such case structure.

Accordingly, it may be appreciated that there continues to be a need for a new and improved spectacle case as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of spectacle case apparatus now present in the prior art, the present invention provides a spectacle case wherein the same utilizes an adhesive web mounting a clip thereon, wherein the web is adherably mounted to an interior surface of the flexible outer liner to secure the clip to the outer liner in use. As such, the general purpose of the present invention, which will be described subsequently in greater detail, is to provide a new and improved spectacle case which has all the advantages of the prior art spectacle cases and none of the disadvantages.

To attain this, the present invention provides a flexible porous inner web mounted to a fluid impermeable outer web to define an entrance opening to receive a spectacle case, wherein the inner web includes an adhesive web including an adhesive forward face mounting a "U" shaped clip, and an adhesive rear face adhesively secured to the inner web, wherein the "U" shaped clip includes a junction and the outer web includes a slot, wherein the junction is aligned with the slot, with the inner web secured to the outer web. The case structure may further utilize the adhesive web formed with adhesive at a forward surface thereof and mounted to an interior surface of the outer web to secure the clip through the slot and the outer web without use of an inner liner. A modification of the invention includes the inner liner including an anhydrous dispensing tube contained therewithin for direction a water absorbing mixture from interiorly of the case structure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved spectacle case which has all the advantages of the prior art spectacle cases and none of the disadvantages.

It is another object of the present invention to provide a new and improved spectacle case which may be easily and efficiently manufactured and marketed.

It is a further object of the present invention to provide a new and improved spectacle case which is of a durable and reliable construction.

An even further object of the present invention is to provide a new and improved spectacle case which is susceptible of a low cost of manufacture with regard to both materials and labor, and which accordingly is then susceptible of low prices of sale to the consuming public, thereby making such spectacle cases economically available to the buying public.

Still yet another object of the present invention is to provide a new and improved spectacle case which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is an isometric illustration of the adhesive patch mounted to the inner liner.

FIG. 8 is an isometric illustration of the outer liner utilized by the invention.

FIG. 9 is an orthographic frontal view, taken in elevation of the outer liner.

FIG. 10 is an orthographic view, taken along the lines 10—10 of FIG. 9 in the direction indicated by the arrows.

DESCRIPTION OF THE PREFERRED EMBODIMENT

Figure 1:
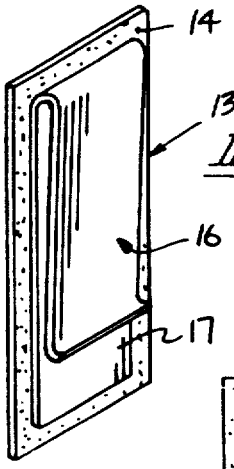
FIG. 1 is an isometric illustration of the adhesive web utilized by the invention.

With reference now to the drawings, and in particular to FIGS. 1 to 12 thereof, a new and improved spectacle case embodying the principles and concepts of the present invention and generally designated by the reference numerals 10 and 10*a* will be desribed.

Figure 11:
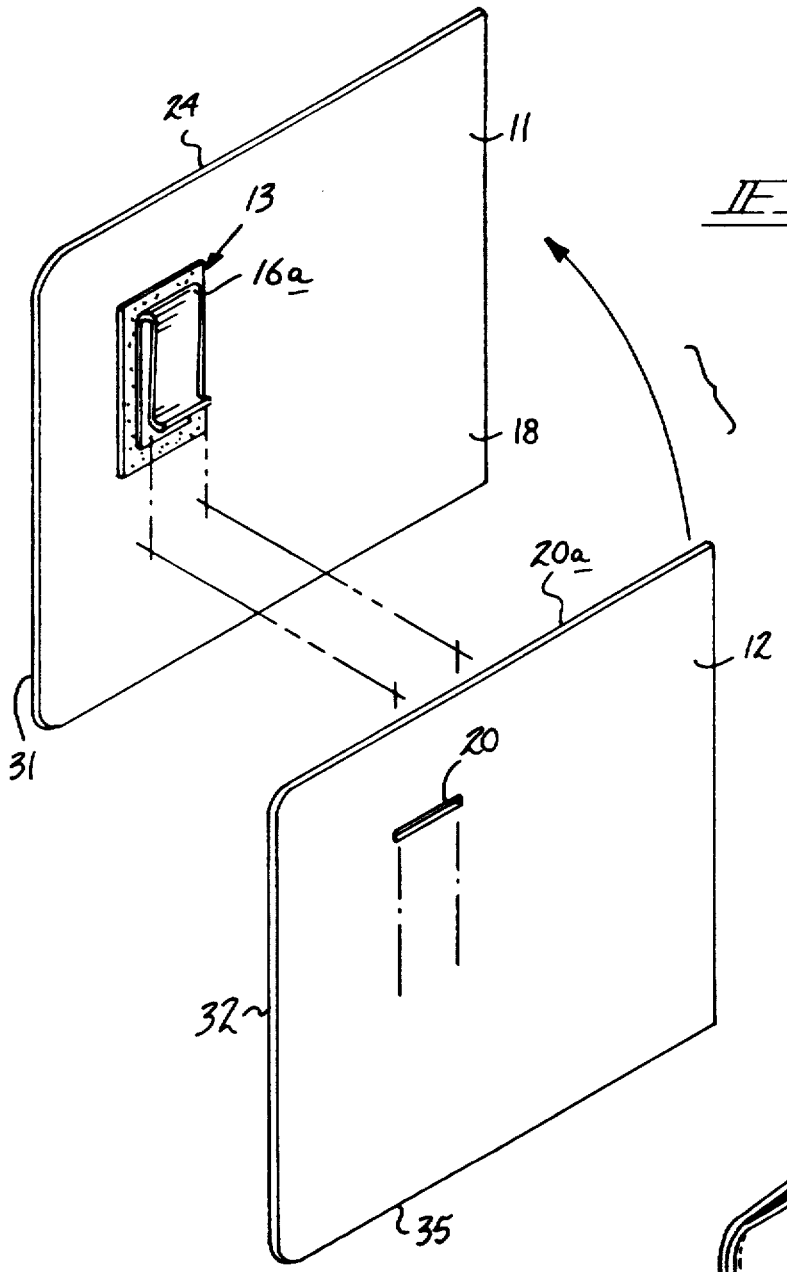
FIG. 11 is an isometric illustration of the inner liner construction mounted to the outer liner.
Figure 12:
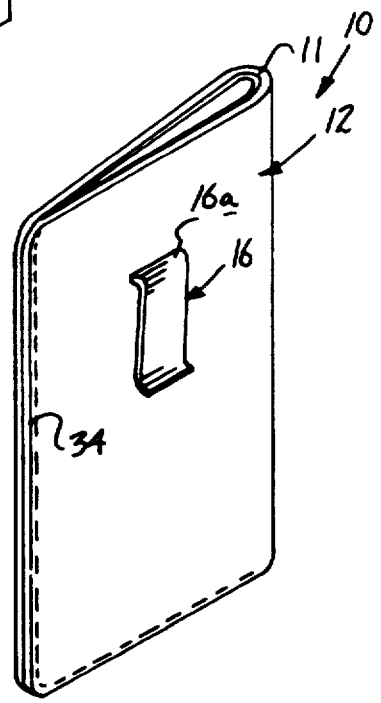
FIG. 12 is an isometric illustration of the assembled spectacle case.

More specifically, the spectacle case 10 of the instant invention, as illustrated in FIG. 12 for example, includes a fluid impermeable outer liner web 12 that is formed with an outer web forward space surface 21 and an outer web rear surface 22, including an outer web first side edge 32 and an outer web bottom edge 35 (see FIG. 11). An outer web enclosed slot 20 is directed through the outer web spaced from an outer web top edge 20*a* a predetermined first distance and spaced from the first side edge 32 a perdetermined second distance. In the first embodiment of the invention, a flexible adhesive web 13 that includes a forward adhesive surface 14 adherably secures a "U" shaped spring clip 16 thereto medially of the forward adhesive surface 14. The forward adhesive surface 14 is mounted to the outer web 12 and the outer web rear surface 22 to direct the "U" shaped spring clip 16 through the slot 20. The spring clip 16 includes a clip planar rear leg 17 coextensively mounted to the adhesive forward surface, and a clip forward leg 17*a* positioned in a spaced relationship relative to the rear leg 17. A "U" shaped clip arcuate junction 16*a* is directed through and aligned with the slot 20. The adhesive web rear suface 15 thereafter projects interiorly of the surface 22, whereafter the outer liner web 12 is folded medially of itself with a seam 34 directed through the outer web first side edge 32 and the outer web bottom edge 35.

Figure 2:
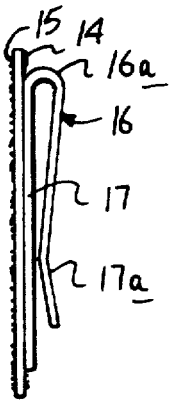
FIG. 2 is an orthographic side view of the adhesive web mounting the clip structure thereon.
Figure 3:
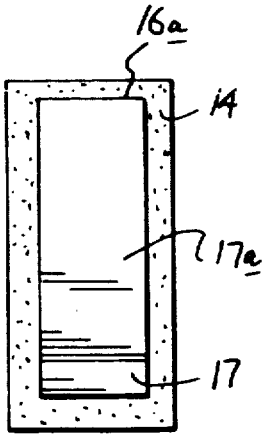
FIG. 3 is an orthographic front view, taken in elevation, of the adhesive web.
Figure 4:
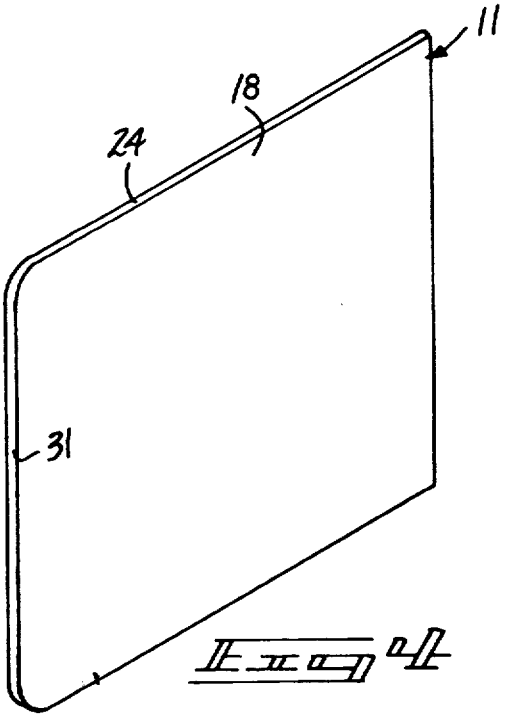
FIG. 4 is an isometric illustration of an inner liner for use by the instant invention.
Figure 5:
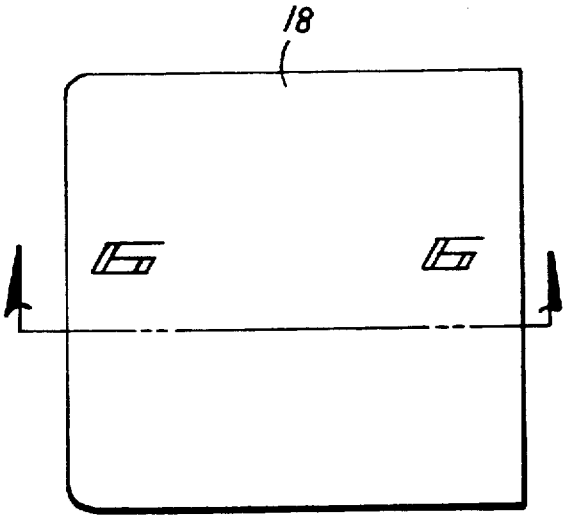
FIG. 5 is an orthographic frontal view of the liner, as set forth in FIG. 4.
Figure 6:
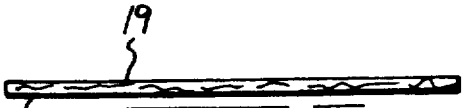
FIG. 6 is an orthographic view, taken along the lines 6—6 of FIG. 5 in the direction indicated by the arrows.
Figure 7A:
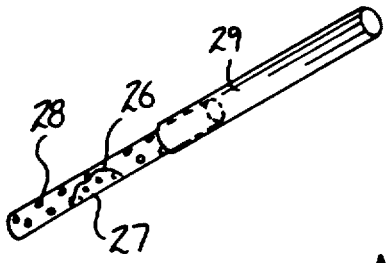
FIG. 7*a* is an isometric illustration of the dispensing tube structure utilized by the invention.
Figure 8A:
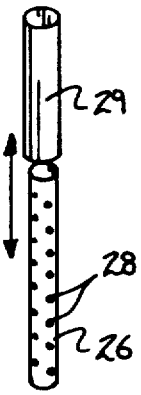
FIG. 8*a* is an isometric illustration of the modified spectacle case of the instant invention.
Figure 8A:
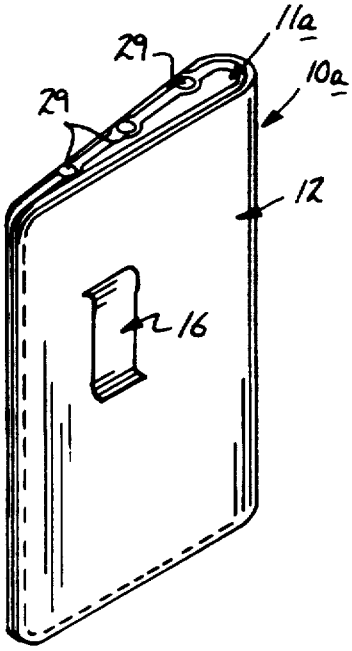
Figure 6A:
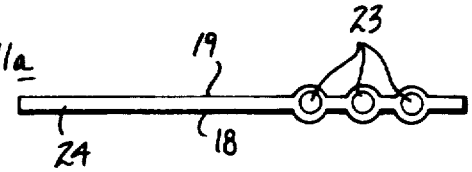
FIG. 6*a* is an orthographic top view of the modified liner construction.

In the use of an inner liner, the instant invention contemplates construction of a flexible porous inner liner web 11 defined as illustrated in the FIGS. 4–6 with an inner web forward surface 18 spaced from an inner web rear surface 19. The inner liner is formed of a porous material, as opposed to the fluid impermeable material of the outer liner web 12. In this manner, the inner liner includes an inner liner top edge 24 and an inner liner web first side edge 31. In this construction, the flexible adhesive web 13 includes the rear surface 15 formed with an adhesive coextensive therewith, as illustrated in FIG. 2, and mounted to the inner forard surface 18 to orient the "U" shaped clip arcuate junction 16*a* the predetermined first distance form the inner web top edge 24 in a parellel relationship, and the "U" shaped clip arcuate junction 16*a* the predetermined second distance from the inner liner web first side edge 31. It should be also noted that the outer web enclosed slot 20 is spaced in a parallel relationship relative to the outer web top edge 20*a* in a parallel relationship the same first distance to thereby align the "U" shaped clip arcuate junction 16*a* with the slot in securement of the inner liner web 11 to the outer liner web 12. The inner liner web is formed with a bottom edge 25 such that the inner liner web 11 and the outer liner web 12 are of an equal configuration coextensive relative to one another when secured together defined by an equal predetermined height. In this manner, the seam 34 secures the inner liner web 11 and the outer liner web together to define an entrance opening to receive a spectacle assembly therethrough within the spectacle case 10.

Figure 4A:
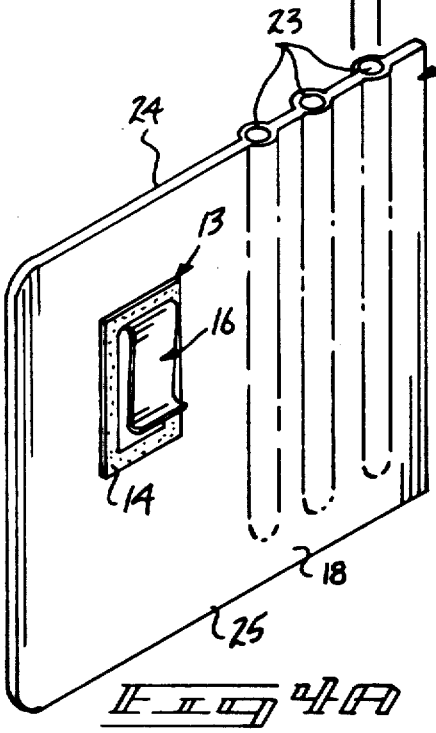
FIG. 4*a* is an isometric illustration of a modified inner liner utilized by the invention.
Figure 5A:
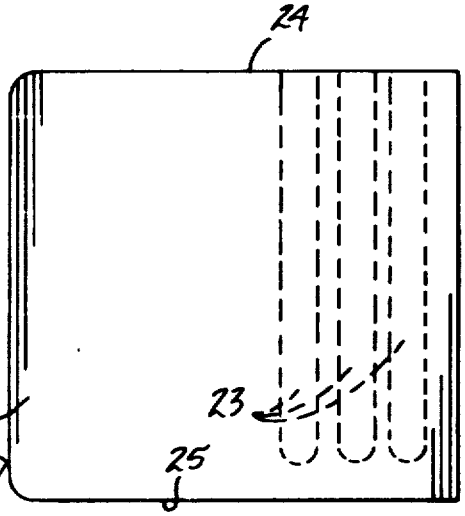
FIG. 5*a* is an orthographic frontal view, taken in elevation, of the modified liner construction.

The FIGS. 4*a*–8*a* illustrate a modified inner liner web 11 that includes a plurality of parallel cylindrical wells 23 each defined by a predetermined length less than the predetermined height of the inner web 11. The wells are directed into the liner from the inner web top edge 24 and spaced from the inner web bottom edge 25, as illustrated in FIGS. 4*a* and 5*a*. Fluid filled dispenser tubes 26 are provided, with a tube 26 arranged for reception within each of the wells, wherein each of the tubes is filled with anhydrous fluid. As the cylindrical wells 23 defined by a predetermined length, each of the tubes 26 are defined by a length equal to one-half the predetermined length, with a matrix of dispensing tube apertures 28 directed through each of the tube 26. A metering cover tube 29 defined by a length equal one-half the predetermined length is slidably mounted over the resepective tube 26 to selectively uncover the apertures 28 to provide metering of the anhydrous fluid 27 into the porous inner liner web 11. In this manner, an eyeglass or spectacle pair directed within the thusly formed case 10*a* is provided a water-free environment as the anhydrous fluid absorbs such water permitting the glasses to have excess water removed thereform, as well as from the lenses frequently resulting in fogging during use of the lenses. Since the metering cover tube 29 and the dispensing tube 26 are each one-half the length, the cover tube may be arranged to telescope the tube 26 a partial or complete length relative to the cover tube 29 within each of the wells 23.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A spectacle case, comprising, a fluid impermeable flexible outer web, the outer web including an outer web forward surface and an outer web rear surface coextensive to one another, and an outer web top edge and an outer web first side edge orthogonally intersecting the outer web top edge, and the outer web including an outer web bottom edge, and the outer web defining a predetermined height between the outer web bottom edge and the outer web top edge, and the outer web including a slot arranged parallel to the outer web top edge and the outer web bottom edge directed through the outer web, and the slot spaced below the outer web top edge a predetermined first distance, and the slot spaced from the outer web first side edge a predetermined second distance, and a flexible adhesive web, the flexible adhesive web including a forward adhesive surface and a rear surface spaced from the forward adhesive surface, the forward adhesive surface including a "U" shaped spring clip mounted thereon, the "U" shaped spring clip including a clip planar rear leg mounted to the forward adhesive surface, and the planar rear leg including a clip forward leg, with a "U" shaped clip arcuate junction defined between the planar rear leg and the clip forward leg, and the forward adhesive surface adherably mounted to the outer web rear surface, with the "U" shaped clip arcuate junction positioned within the slot, and the outer web including an outer web second side edge spaced from the first side edge, with the second side edge and the first side edge secured together to include a seam, and the outer web bottom edge including the seam directed therethrough to define a pocket to receive a spectacle assembly therewithin, and a flexible porous inner liner web mounted coextensively to the outer web rear surface, and the flexible adhesive web rear surface including a further adhesive member mounted thereon to adhesively secure the rear surface to the flexible adhesive web, and the flexible porous inner web including an inner web first side edge spaced from an inner web second side edge, wherein the inner web first side edge and the inner web second side edge are contiguous and coextensive with the outer web first side edge and the outer web second side edge, and the inner web including an inner web bottom edge spaced from an inner web top edge, wherein the inner web bottom edge and the inner web top edge are coextensively contiguous with the outer web bottom edge and the outer web top edge respectively, with the seam directed through the inner web first side edge and the second side edge and the inner web bottom edge to define a liner within the spectacle case, and the inner web includes a plurality of parallel cylindrical wells directed into the inner web, wherein each of the wells are defined by a predetermined length less than the predetermined height, and wherein the wells are spaced above the inner web bottom edge, an a plurality of dispensing tubes arranged for reception of each of the wells, each dispensing tube includes a fluid filled dispensing tube defined by a length equal to one-half the predetermined length of said wells, and each of the dispensing tubes includes an anhydrous fluid contained within each of the dispensing tubes, and each dispensing tube includes a matrix of dispensing tube apertures directed through each dispensing tube to direct the anhydrous fluid into the porous inner liner web, and a metering cover tube defined by a tube length equal to the one-half predetermined length, wherein the dispensing tube is telescopingly and slidably received within the metering cover tube, the metering cover tube formed of a fluid impermeable material and arranged to selectively expose a predetermined portion of the dispensing tube apertures to meter the anhydrous fluid directed through the apertures.

* * * * *